United States Patent [19]

Neisen

[11] Patent Number: 4,504,238

[45] Date of Patent: Mar. 12, 1985

[54] FLUID COOLER FOR MARINE DRIVES

[75] Inventor: Gerald F. Neisen, Oshkosh, Wis.

[73] Assignee: Brunswick Corporation, Skokie, Ill.

[21] Appl. No.: 452,849

[22] Filed: Dec. 23, 1982

[51] Int. Cl.[3] ..... B63H 21/32

[52] U.S. Cl. ..... 440/89; 60/310; 123/41.08

[58] Field of Search ..... 440/88, 89; 60/310; 123/41.08, 41.09, 41.3, 41.33, 196 AB; 165/51, 52

[56] References Cited

U.S. PATENT DOCUMENTS

| | | | |
|---|---|---|---|
| 3,206,836 | 9/1965 | Schlussler | 440/89 |
| 3,380,443 | 4/1968 | Tado et al. | 123/196 AB |
| 3,921,398 | 11/1975 | Kashmerick | 440/89 |

FOREIGN PATENT DOCUMENTS

| | | | |
|---|---|---|---|
| 961709 | 1/1975 | Canada | 440/88 |
| 232309 | 4/1925 | United Kingdom | 123/41.33 |
| 778679 | 7/1957 | United Kingdom | 165/51 |
| 818560 | 8/1959 | United Kingdom | 165/51 |
| 829103 | 2/1960 | United Kingdom | 165/51 |
| 1603962 | 12/1981 | United Kingdom | 181/212 |

*Primary Examiner*—Trygve M. Blix
*Assistant Examiner*—Jesûs D. Sotelo
*Attorney, Agent, or Firm*—Andrus, Sceales, Starke & Sawall

[57] ABSTRACT

A fluid cooler for hydraulic or other fluids in the marine drive is provided in the exhaust pipe of a marine drive so that cooling water in the exhaust pipe may remove heat from fluid in the cooler. The cooler may comprise fins on the exterior of the portion of the exhaust pipe containing the cooling water. The fins extend into a chamber through which the fluid circulates. Or, the cooler may comprise a pipe embedded in the wall of the portion of the exhaust pipe containing the cooling water. The fluid flows through the pipe for cooling.

6 Claims, 6 Drawing Figures

FLUID COOLER FOR MARINE DRIVES

Marine drives of the inboard-outboard, stern drive type employ water cooled engines. After the cooling water has circulated through the engine block, it is discharged into the exhaust pipe to cool the pipe. In a lower bend of the exhaust pipe, the water and exhaust gases are separated by a baffle plate. The exhaust gases are discharged through the propeller hub and the water is discharged through a cooling system discharge port of the boat.

Many stern drives are equipped with hydraulically powered accessories, such as power steering. It is necessary to cool the hydraulic fluid in these accessories to insure proper operation. A hydraulic fluid cooler is therefore provided in the hydraulic system in which the fluid is cooled by the water in which the boat is operating. The cooler and attendant mounting brackets and plumbing add substantially to the manufacturing and maintenance costs of the hydraulic system and the marine drive.

The gist of the present invention is to utilize the separated cooling water present in the exhaust pipe to cool the fluid in the hydraulic system. Highly effective cooling is provided to the hydraulic fluid, as the temperature of the water in the exhaust system is sufficiently low as to maintain the operating temperature of the hydraulic fluid below desired maximums. At the same time, the cost of the hydraulic system is reduced and its reliability enhanced.

To this end, a cooling means is provided in the exhaust pipe to transfer heat from the hydraulic fluid to the cooling water in the exhaust pipe. Such a cooling means may comprise fins on the exterior of the portion of the exhaust pipe containing the cooling water. The fins extend into a chamber through which the hydraulic fluid circulates. Or, such a cooling means may comprise a pipe embedded in the wall of the portion of the exhaust pipe containing the cooling water.

The invention will be further understood by reference to the following detailed description of various embodiments of the invention, taken in conjunction with the drawing. In the drawing.

Figure 1:
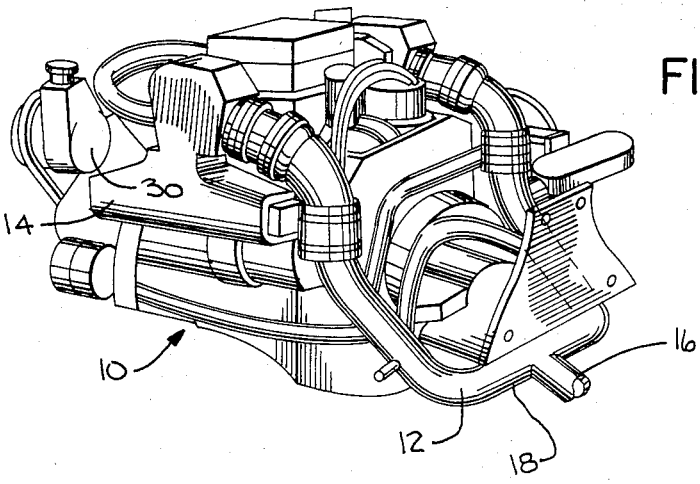
FIG. 1 is a perspective view of the engine of a marine drive showing the exhaust pipe.

In FIG. 1, engine 10 of the marine drive has exhaust pipe 12 for conducting exhaust gases from exhaust manifold 14 to discharge pipe 16. Discharge pipe 16 discharges the exhaust gases out the drive unit of the marine drive. Exhaust pipe 12 has a generally U-shaped configuration to extend between the two banks of cylinders of the V-block of engine 10. Discharge pipe 16 is connected to middle, lower portion 18 of exhaust pipe 12. For an in-line engine, exhaust pipe 12 would comprise half of the U-shaped exhaust pipe shown in FIG. 1.

Figure 2:
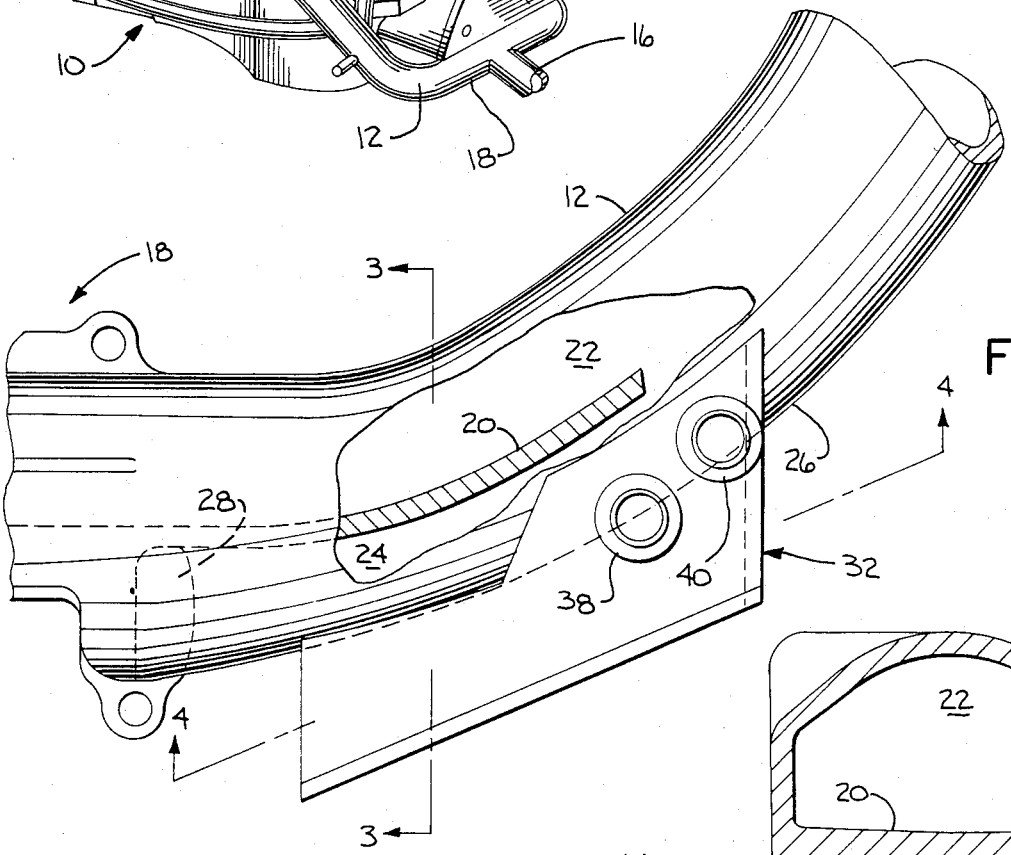
FIG. 2 is a a partially broken away view of portions of the exhaust pipe showing one embodiment of the hydraulic fluid cooler of the present invention.
Figure 3:
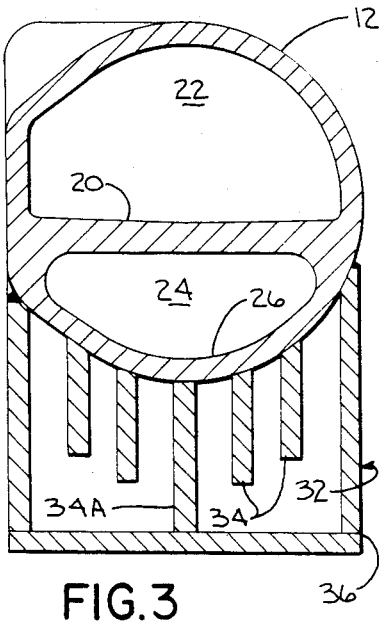
FIG. 3 is a cross-sectional view along the line 3—3 of FIG. 2.

As shown in FIG. 2, lower portion 18 of exhaust pipe 12 contains baffle plate 20 extending along exhaust pipe 12 in the central portion thereof. As shown in FIG. 3, baffle plate 20 separates lower portion 18 into inner passage 22 and outer chamber 24. The cooling water of engine 10 is discharged out exhaust manifold 14 into exhaust pipe 12 after circulation through engine 10. As the cooling water travels along exhaust pipe 12 with the exhaust gases, it is moved toward the outer wall 26 of exhaust pipe 12 by centrifugal force. When the water reaches lower portion 18 containing baffle plate 20, most of the water passes under baffle plate 20 where it collects in chamber 24 for discharge out port 28. The exhaust gases pass over baffle plate 20 along passage 22 to discharge pipe 16. Separation of the exhaust gases and the cooling water is thus achieved in exhaust pipe 12.

Engine 10 drives hydraulic fluid pump 30 for hydraulic accessories, such as a power steering system. Unless cooled, the hydraulic fluid circulated by hydraulic fluid pump 30 will rise to a temperature at which degradation of the fluid or system components or faulty operation of the system may result. To avoid this, the hydraulic fluid is cooled, typically upstream of pump 30. As noted above, in the past, this cooler has been a separate element in the hydraulic system having its own water feed and return conduits. The cooler is mounted on the engine or elsewhere in the marine drive. The cost of the cooler and its plumbing and mounting adds to the expense of the marine drive.

To obviate these and other shortcomings, the present invention incorporates a hydraulic fluid cooler 32 in exhaust pipe 12 to utilize the cooling water in lower portion 18 to cool the hydraulic fluid. A simple and economical means of cooling the hydraulic fluid is thus provided. In hydraulic fluid cooler 32, shown in FIGS. 2, 3, and 4, cooling fins 34 extend from the exterior of outer wall 26 of lower portion 18. Jacket 36 surrounds cooling fins 34 and contains inlet and outlet ports 38 and 40 connected to hydraulic fluid supply and discharge lines 42 and 44, respectively.

Figure 4:
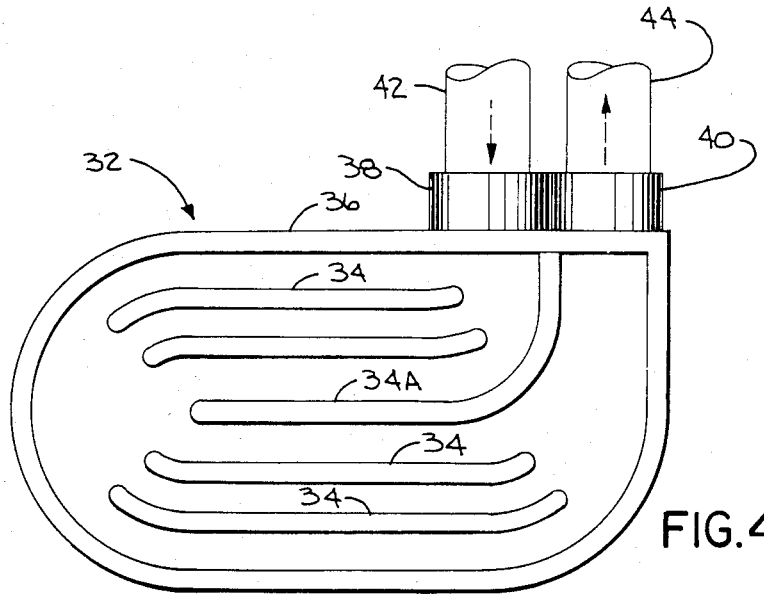
FIG. 4 is a cross-sectional view along the line 4—4 of FIG. 2.

As shown in FIG. 4, cooling fins 34 may be formed, in a direction parallel to the flow of the hydraulic fluid, in a shape that aids such flow through jacket 36. Central fin 34A may serve to separate the inlet of jacket 36 from its outlet.

Cooling fins 34 and jacket 36 may be formed as weldments on the exterior of exhaust pipe 12. Or, the fins and jacket may be integrally cast with exhaust pipe 12. An appropriate mold shake out opening would be provided in jacket 36 that is plugged after the mold is removed.

In the operation of a typical hydraulic fluid cooler 32 of the present invention, the cooling water in chamber 24 of lower portion 18, was about 135°–150° F. This provided sufficient cooling to the hydraulic fluid to maintain the temperature of the fluid below the degradation point of 300° F. for all anticipated operating pressures of the hydraulic system.

Figures 5, 6:
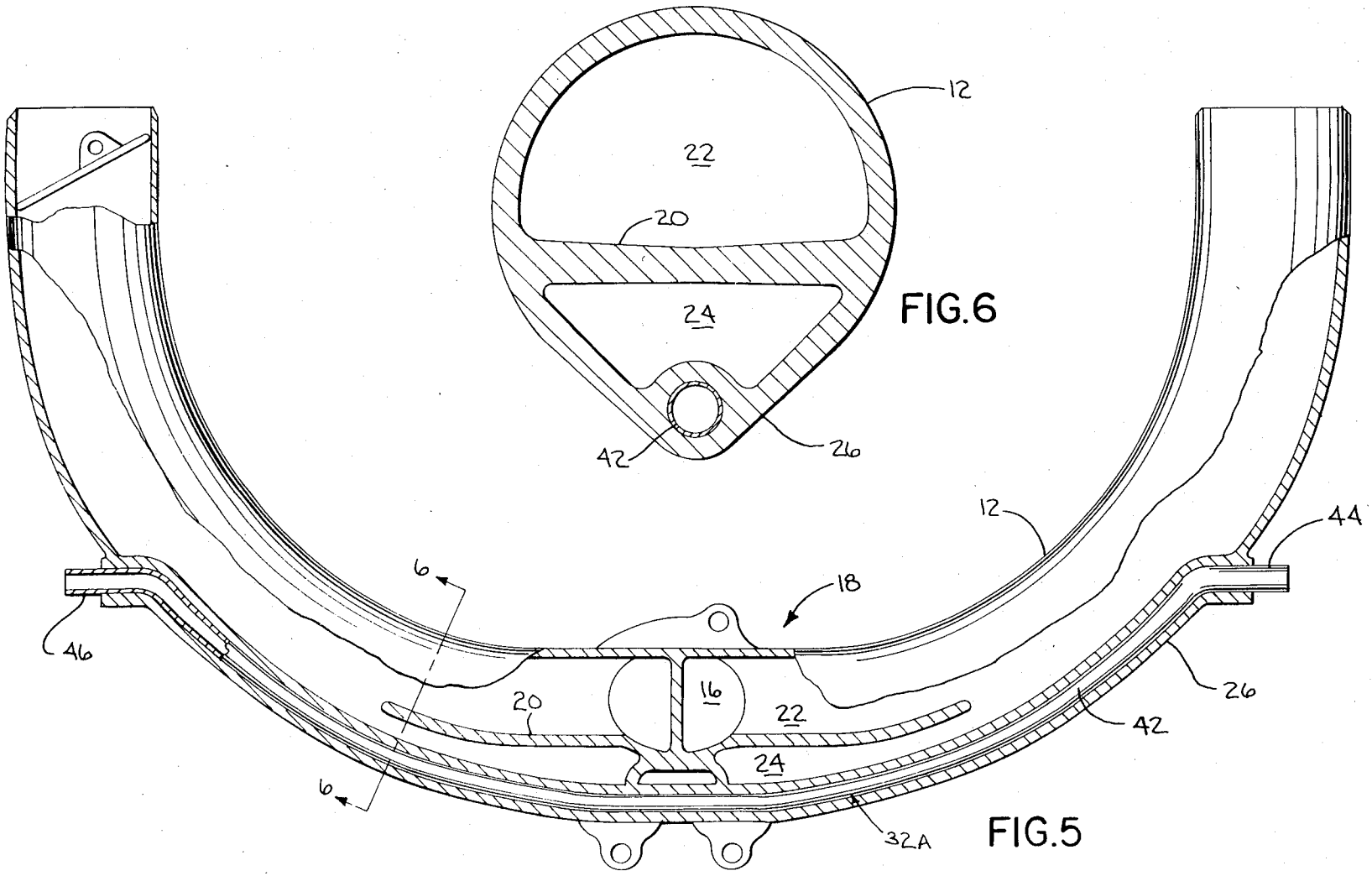
FIG. 5 is a partially broken away view of portions of the exhaust pipe showing another embodiment of the hydraulic fluid cooler of the present invention.
FIG. 6 is a cross-sectional view taken along the line 6—6 of FIG. 5.

FIGS. 5 and 6 show another embodiment of the hydraulic fluid cooler 32A of the present invention. In cooler 32A, pipe 42 is embedded in the wall 26 of lower portion 18 of exhaust pipe 12 to receive heated hydraulic fluid at one end 44 and to discharge cooled hydraulic fluid at the other end 46. As with cooler 32, the hydraulic fluid is cooled by contact with the cooling water in chamber 24 in lower portion 18.

Pipe 42, formed of stainless steel, copper, or other suitable material, may be embedded in wall 26 of lower portion 18 by placing the pipe in the mold during the casting of exhaust pipe 12.

Depending on the configuration of engine 10, pipe 42 may comprise part of the plumbing of the hydraulic system. For example, it may transfer hydraulic fluid from power steering apparatus located on one side of engine 10 to pump 30 located on the other side of the engine.

While the invention has been described as cooling the hydraulic fluid utilized in a power steering system, it will be appreciate that it can cool other fluids, such as the crankcase oil or transmission fluid, associated with engine 10.

Various modes of carrying out the invention are contemplated as being within the scope of the following claims particularly pointing out and distinctly claiming the subject matter which is regarded as the invention.

I claim:

1. In a marine drive incorporating an engine with an exhaust pipe having a cooling water medium discharged from the engine contained therein and lying along a wall of the pipe within at least a portion thereof, said marine drive having a liquid heated by operation of the drive, an improved liquid cooling means comprising:

liquid flow means through which the heated liquid flows, said liquid flow means being coupled in heat transfer relation to the portion of the exhaust pipe having the cooling water medium contained therein lying along the wall for transferring heat from the liquid to the cooling water medium in the exhaust pipe as the liquid flows through said cooling means.

2. The improved liquid cooling means of claim 1 wherein said liquid flow means includes a jacket through which the liquid flows mounted on the exterior of the portion of the exhaust pipe.

3. The improved liquid cooling means of claim 2 wherein said liquid flow means includes cooling fins mounted on the exterior of the portion of the exhaust pipe and wherein said jacket surrounds said cooling fins.

4. The improved liquid cooling means of claim 1 wherein said liquid flow means comprises a conduit imbedded in the portion of the exhaust pipe.

5. The improved liquid cooling means of claim 4 wherein the exhaust pipe is U-shaped and wherein said liquid flow conduit is U-shaped.

6. The improved liquid cooling means of claim 4 wherein said marine drive has a multi-element system employing the liquid and wherein said liquid flow conduit forms a plumbing element of the system for transferring liquid among the elements of the system.

* * * * *